US008720719B2

(12) United States Patent
Hug

(10) Patent No.: US 8,720,719 B2
(45) Date of Patent: May 13, 2014

(54) FOLDABLE TRANSPORT AND STORAGE CONTAINER

(75) Inventor: Yves Hug, Oberwil-Lieli (CH)

(73) Assignee: Georg Utz Holding AG, Bremgarten (CH)

( * ) Notice: Subject to any disclaimer, the term of this patent is extended or adjusted under 35 U.S.C. 154(b) by 61 days.

(21) Appl. No.: 13/422,457

(22) Filed: Mar. 16, 2012

(65) Prior Publication Data

US 2012/0234830 A1 Sep. 20, 2012

(30) Foreign Application Priority Data

Mar. 17, 2011 (CH) ..... 00446/11

(51) Int. Cl.
*B65D 6/18* (2006.01)
*B65D 6/22* (2006.01)

(52) U.S. Cl.
USPC ..... 220/7; 220/6; 220/4.34

(58) Field of Classification Search
USPC ..... 220/6, 7, 4.34
See application file for complete search history.

(56) References Cited

U.S. PATENT DOCUMENTS 3,941,271 A * 3/1976 Zarges et al. ..... 220/6
4,163,495 A * 8/1979 Drader ..... 206/506
5,938,059 A * 8/1999 Luburic ..... 220/6
8,109,402 B2 * 2/2012 Hartwall ..... 220/7
2004/0182858 A1 * 9/2004 Smyers ..... 220/6
2010/0147841 A1 * 6/2010 Tontarelli ..... 220/6
2011/0240639 A1 * 10/2011 Nolan ..... 220/6
2011/0259884 A1 * 10/2011 Kellerer et al. ..... 220/6
2011/0272400 A1 11/2011 Huizingh
2012/0152947 A1 * 6/2012 Orgeldinger ..... 220/7

FOREIGN PATENT DOCUMENTS

DE 102009005212 7/2010

* cited by examiner

*Primary Examiner* — Anthony Stashick
*Assistant Examiner* — Niki Eloshway
(74) *Attorney, Agent, or Firm* — Henry M Feiereisen LLC

(57) ABSTRACT

A plastic container includes at least two foldable sidewalls articulated to a container base by at least two hinge connections, each including a hinge bolt or pin for pivoting in a receiving gap of the base frame. The receiving gap has an elongate opening to allow the hinge bolt to move in the receiving gap from a lower to an upper end position. The opening has a length at least corresponding to the thickness of the sidewall which is thus liftable vertically by at least the thickness. At least two guide elements are formed at the sidewall and received in the base frame in recesses which have a nose defined by an upper edge spaced from an upper edge of the base frame by a distance which corresponds to a length of the guide element from a lower edge of the sidewall to a lower edge of the guide element.

6 Claims, 4 Drawing Sheets

FOLDABLE TRANSPORT AND STORAGE CONTAINER

CROSS-REFERENCES TO RELATED APPLICATIONS

This application claims the priority of Swiss Patent Application, Serial No. CH 00446/11, filed Mar. 17, 2011, pursuant to 35 U.S.C. 119(a)-(d), the content of which is incorporated herein by reference in its entirety as if fully set forth herein.

BACKGROUND OF THE INVENTION

The present invention relates to a foldable transport and storage container of plastic.

The following discussion of related art is provided to assist the reader in understanding the advantages of the invention, and is not to be construed as an admission that this related art is prior art to this invention.

Foldable containers for transporting and storing goods are known which include sidewalls that can be fully folded inwardly or outwardly in order to adjust the container volume to the need at hand. Containers of this type are also known as folding box and typically include a container base to which the sidewalls are linked through hinges. When folding the container, the shorter transverse sidewalls are first folded inwards and then the longitudinal sidewalls are folded inwards. When the sidewalls are taller than half the length of the adjacent side of the folding box, the neighboring sidewalls as well as the respectively opposite sidewalls are placed on top of one another. As a consequence, the hinges of the individual sidewalls in the container base must be arranged at different levels or the sidewalls have varying heights in order for the foldable sidewalls to lie flatly upon one another and to form with the container base a compact stack. The presence of sidewalls of different heights, especially those that oppose one another, as well as the presence of hinges arranged on the container base at different heights adversely affect production and manufacturing costs of folding boxes of this type.

DE 10 2009 005 212 A1 discloses a foldable container having a linkage of the foldable sidewalls to the container base using hinges which have hinge bolts articulated in hinge bolt receivers having recesses in such a way that the hinge bolts are movable in the hinge bolt receivers from a lower end position to an upper end position so that a planar placement of two sidewalls on top of one another is facilitated. As the hinge bolts in the hinge bolt receivers not only pivot but also move vertically, the sidewall oftentimes is caused to tilt during folding up. In other words, the pivot axis of a sidewall does not extend parallel to the base of the folding box during folding up.

It would be desirable and advantageous to provide an improved foldable storage and transport container to address prior art problems and to obviate other prior art shortcomings.

SUMMARY OF THE INVENTION

According to one aspect of the present invention, a foldable storage and transport container of plastic includes a container base comprised of a base frame and a base plate, at least two sidewalls foldable on top of one another, each sidewall having a defined thickness, and at least two hinge connections for articulating each sidewall to the base frame, each hinge connection comprising a hinge bolt or a hinge pin for pivot engagement in a receiving gap of the base frame, with the receiving gap having an elongate opening extending substantially perpendicular to a plane of the base plate to allow the hinge bolt or the hinge pin to move in the receiving gap from a lower end position to an upper end position, with the opening having a length sized to at least correspond to the thickness of the sidewall so that the sidewall is liftable in a vertical direction by at least the thickness thereof, wherein at least two guide elements are formed at the foldable sidewall which are received in corresponding recesses in the base frame, wherein the recesses have a nose defined by an upper edge spaced from an upper edge of the base frame by a distance which corresponds to the length of the guide element from the lower edge of the sidewall to the lower edge of the guide element.

The provision of guide elements in accordance with the present invention for engagement in recesses of the base frame maintains the pivot axis during folding up of the sidewall in parallel relationship to the upper edge of the base frame so that a tilting of the sidewall becomes impossible. A benefit of the present invention resides in the interaction between the sidewalls and the container base via hinge connections and the interaction between the guide elements on the sidewalls and the complementary recesses on the container base. As a result of the hinge connections between the sidewalls and the container base, foldable opposite sidewalls can be made identical and can be placed flatly upon one another so as to form a compact stack jointly with the container base. The sidewalls can easily and quickly be mounted to the container base and easily and quickly be replaced so that overall manufacturing costs are decreased According to another advantageous feature of the present invention, the guide element may have a depression for locking engagement by a projection of the base frame in an area of the upper edge of the base frame.

According to another advantageous feature of the present invention, the hinge bolts or hinge pin are formed at the lower end of the guide element which are received in the receiving gaps of the base frame.

According to another advantageous feature of the present invention, the guide element may have two incisions to divide the guide element in three sections comprised of two outer rail-like hinge arms formed with the hinge bolts or hinge pin, and a center part extending between the hinge arms and having a U-shaped configuration.

According to another advantageous feature of the present invention, partition walls may be provided on opposite sides of the nose in the recesses of the base frame for engagement with the incisions of the guide element.

According to another advantageous feature of the present invention, the receiving gap for the hinge bolts or hinge pin may be formed by inner surfaces of front and rear walls of the base frame.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
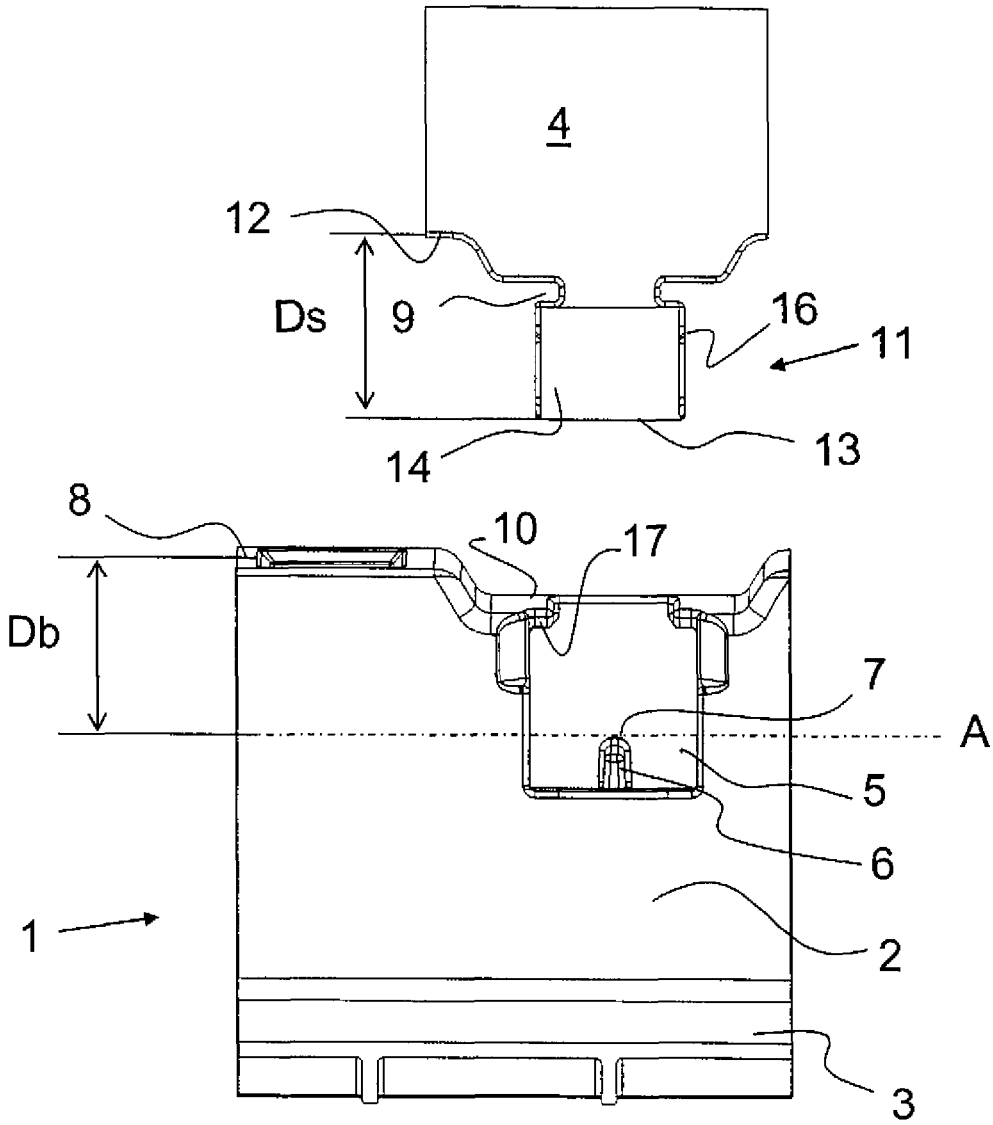
FIG. 1 is a schematic exploded view of a storage and transport container according to the present invention, showing a portion of a container base and a portion of a sidewall with guide elements.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic exploded view of a storage and transport container according to the present invention, showing a portion of a container base, generally designated by reference numeral 1, and a portion of a sidewall 4 which is connectable to the container base 1 via a hinged connection, as described e.g. in DE 10 2009 005 212 A1. The container base 1 includes a base frame 2 and a base plate 3 which may be made in one piece with the base frame 2. The base frame 2 includes a recess 5 for receiving a guide element 11 of the sidewall 4. Arranged in the recess 5 is a nose 6 having an upper edge 7 which is spaced from an upper edge 8 of the base frame 2 at a distance Db. The guide element 11 is formed onto the sidewall 4 and has a length Ds as measured from a lower edge 12 of the sidewall 4 to a lower edge 13 of the guide element 11. The length Ds of the guide element 11 corresponds to the distance Db in the base frame 2. When the sidewall 4 articulated to the base frame 2 is positioned in a vertical alignment, the lower edge 12 of the sidewall 4 bears upon the upper edge 8 of the base frame 2. In addition, the lower edge 13 of the guide element 11 bears upon the upper edge 7 of the nose 6.

An imaginary connection line in this position of separate hinge members, such as hinge bolts or hinge pin (not shown), of the sidewall 4 defines a pivot axis A. The nose 6 is arranged in the recess 5 in such a manner that the pivot axis A extends through the upper edge 7 of the nose 6.

The guide element 11 has a depression 9 for engagement by a projection 10 of the base frame 2 in the area of the upper edge 8. In a horizontal position of the sidewall 4, i.e. substantially parallel to the base plate 3, and with the hinge members assuming their lower end positioned in receiving gaps of the base plate (not shown), the lower edge 13 and part of the front surface 14 of the guide element 11 bears upon the upper edge 7 of the nose 6.

At least two guide elements 11 with associated recesses 5 are provided per sidewall 4 so that the pivot axis A extends parallel to the upper edge 8 of the base frame 2. When now folding up the sidewall 4, the lower edges 13 of the guide elements 11 bear upon the upper edges 7 of the noses 6, respectively, and the sidewall 4 can be swung without tilting. When a folded down sidewall 4 occupies a position above the base plate 3 in which the hinge members 19 assume their uppermost end position or assume a position between the uppermost and lowermost positions, the backside 16 of the guide element 11 impacts the front edge 17 of the projection 10, when the sidewall 4 is folded up. The sidewall 4 is swung about the front edge 17 and since the hinge members 19 can only be shifted vertically in the receiving gaps 15, the sidewall 4 and thus also the lower end of the sidewall 4 are pushed downwards until the lower edge 13 of the guide element 11 bears upon the upper edge 7 of the nose 6. In this position, the backside 16 of the guide element 11 bears no longer on the front edge 17 of the projection 10, and the projection 10 engages in the depression 9.

In the schematic illustration of FIG. 1, the recess 5 and the guide element 11 have symmetric configuration so that the guide element 11 has on both sides a depression 9. Of course, a symmetric configuration is not necessarily required.

In the following, a further embodiment of a foldable storage and transport container, wherein the guide elements are combined with the hinge elements, will be described in greater detail.

Figure 2:
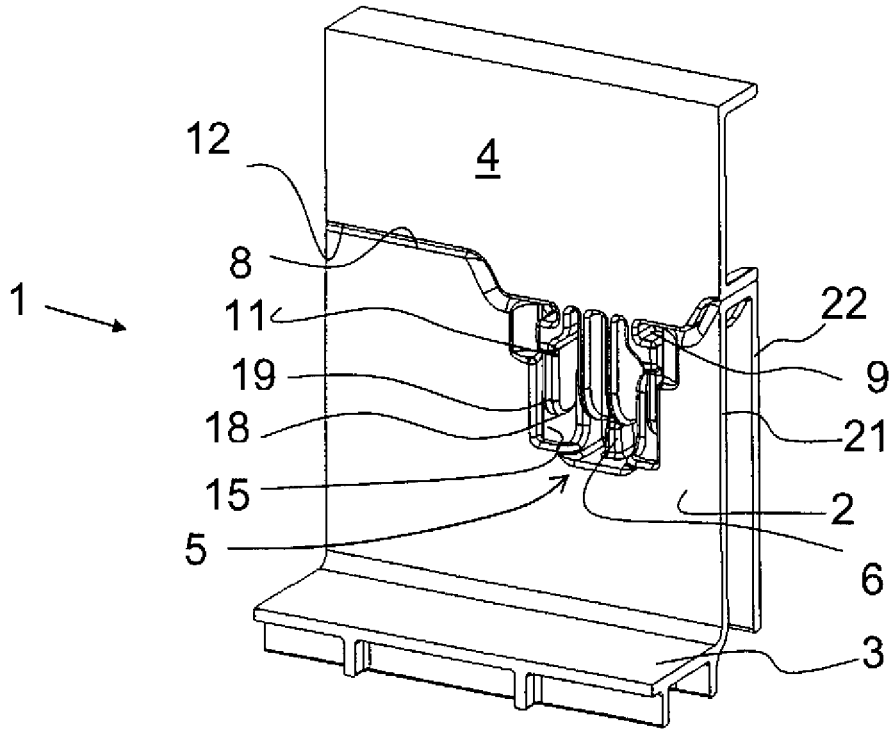
FIG. 2 is a schematic perspective view of the container base with attached sidewall in a folded up position, showing in detail the area of a hinge connection between the sidewall and the container base, wherein the hinge elements are integrated with the guide elements.

FIG. 2 shows a schematic perspective view of the container base 1 with attached sidewall 4 in a folded up disposition, showing in detail the area of the complementing hinged connection between the sidewall 4 and the container base 1. The base frame 2 has a double-walled configuration and the hinge element is integrated with the guide element 11. The guide element 11 has a defined thickness which substantially corresponds to a thickness of the sidewall 4. The guide element 11 has a lower end 18 which is formed with hinge bolts 19 which project into the receiving gaps 15 of the base frame 2. The receiving gap 15 is formed by inner surfaces of the front and rear walls 21, 22 of the base frame 2.

Figure 3:
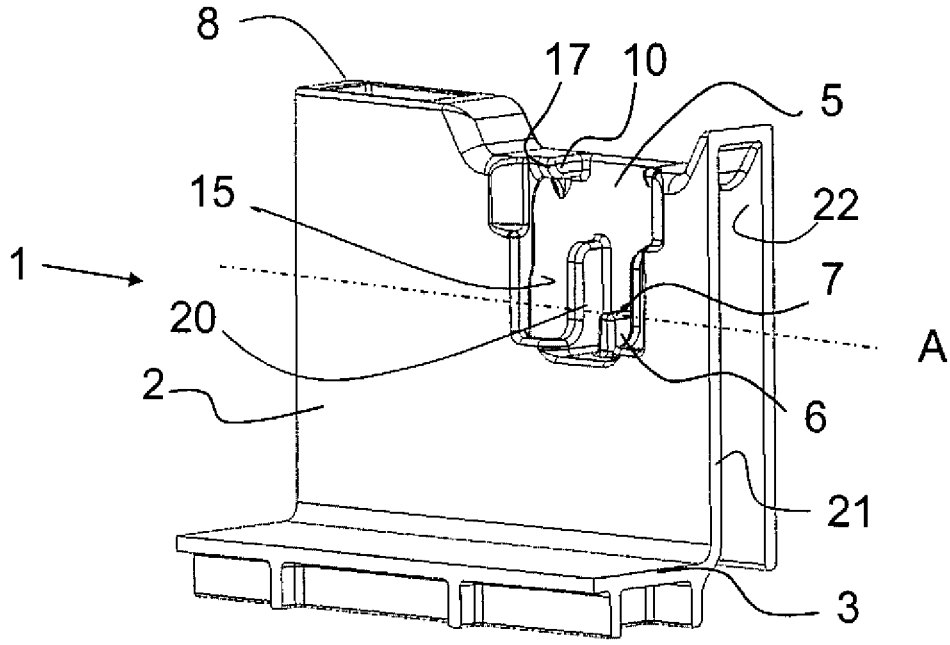
FIG. 3 is a schematic perspective view of the container base with a first part of the hinge connection.

FIG. 3 shows a schematic perspective view of the container base 1 with the recess 5 in the base frame 2, without illustration of the sidewall 4. The nose 6 is arranged in midsection of the recess 5. The arrangement of the nose 6 in the recess 5 is selected in such a way that the pivot axis A intersects the upper edge 7 of the nose 6, when the lower edge 13 of the guide element 11 bears upon the upper edge 7 of the nose 6 and the lower edge 12 of the sidewall 4 bears upon the upper edge 8 of the base frame 2. The projection 10 with the front edge 17 can be seen at the upper end of the recess 5. The recess 5 has symmetric configuration so that both sides of the recess 5 have a projection 10 extending into the recess 5. At least two such recesses 5 are provided along each side of the base frame 2 of the storage and transport container.

Figure 4:
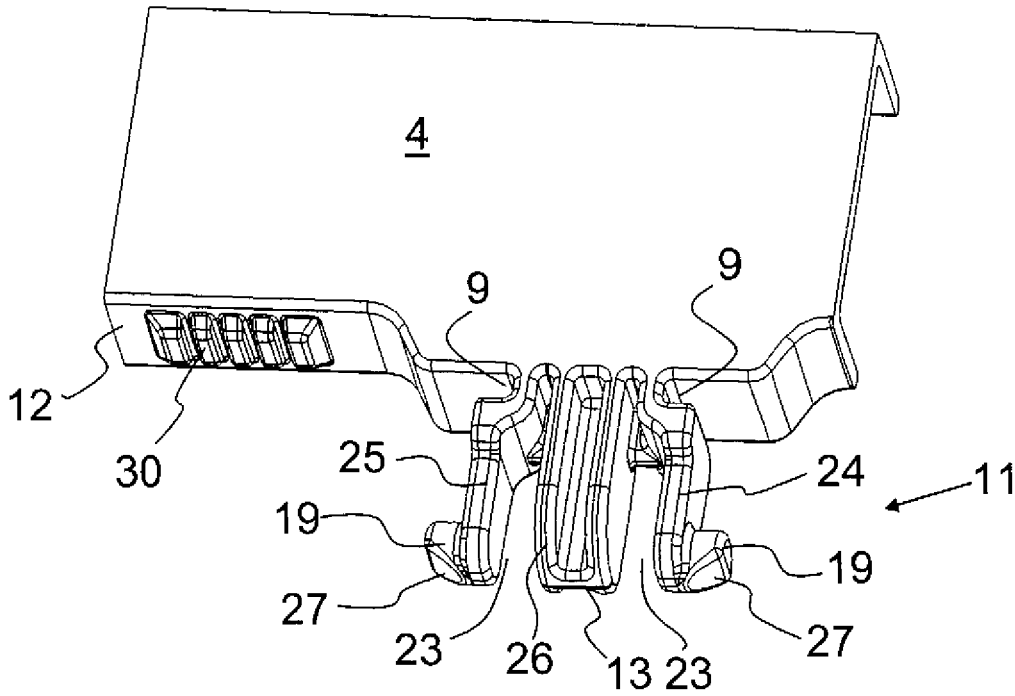
FIG. 4 is a schematic perspective view of the sidewall with a second part of the hinge connection, corresponding to the first part.

FIG. 4 shows a schematic perspective view of the sidewall 4 in the area of the hinge connection, with the guide element 11 being formed on the sidewall 4. The depression 9 of the guide element 11 is arranged adjacent to the lower edge 12 of the sidewall 4. In the non-limiting example shown here, the guide element 11 has a thickness substantially corresponding to the thickness of the sidewall 4. The guide element 11 has two incisions 23 so as to establish a three-part configuration, comprised of two outer rail-like hinge arms 24, 25 with respectively formed hinge bolts 19. Arranged between the hinge arms 24, 25 is a center part 26 of U-shaped configuration which defines the lower edge 13 of the guide element 11. The hinge arms 24, 25 as well as the U-shaped center part 26 are rounded at the lower ends.

When the sidewall 4 is articulated to the base frame 2, the hinge bolts 19 engage into the receiving gaps 15. When the sidewall 4 is folded up, the lower edge 12 of the sidewall 4 bears upon the upper edge 8 of the base frame 2. In this position, the lower edge 13 of the guide element 11 bears upon the nose 6. When the sidewall 4 is folded down, the nose 6 engages the U-shaped center part 26. Partition walls 20 (FIG. 3) arranged on both sides of the nose 6 prevent the hinge bolts 19 from being pushed out of the receiving gap 15. The partition walls 20 are sized to extend shy of the entire length of the incision 23 of the guide element 11 in order to allow insertion or removal of the hinge bolts 19 to or from the receiving gaps 15 by pushing the hinge arms 24, 25 away to the side, when the folded down sidewall 4 assumes the uppermost position. To facilitate the insertion of the hinge bolts 19 in the receiving gap 15, the hinge bolts 19 are formed with a bevel 27 and the side surfaces (FIG. 5) of the recess 5 of the base frame 2 are also beveled in an upper area 28.

To prevent the sidewall 4 from folding down, when assuming the folded up position, safeguards are provided on the lower edge 12 of the sidewall 4 and on the upper edge 8 of the base frame 2. These safeguards involve recesses 29 in the upper edge 8 of the sidewall 4 and locking lugs or projections 30 projecting from the lower edge 12 of the sidewall 4 for engagement in the depressions 29.

Figure 5:
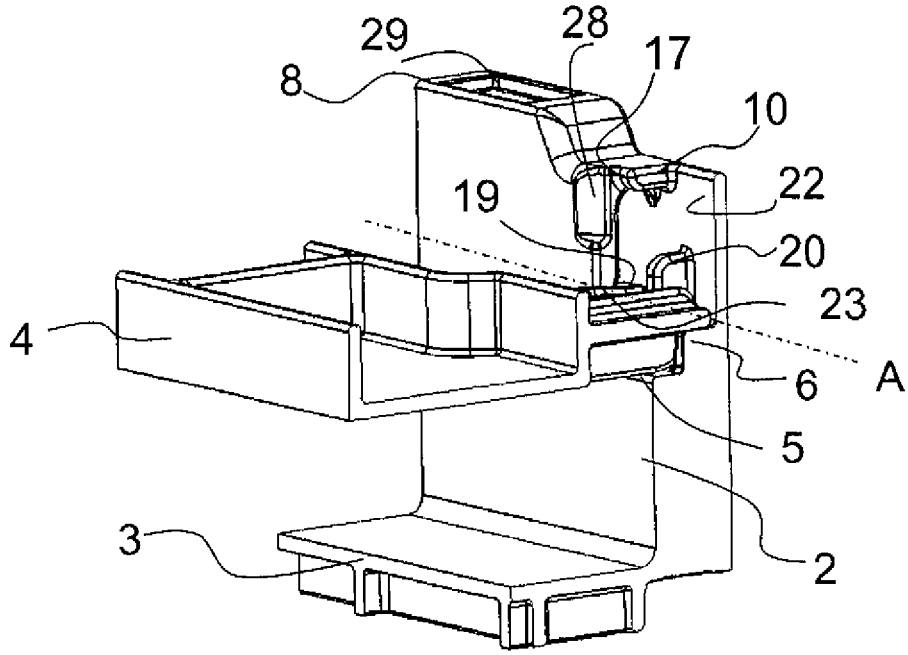
FIG. 5 is a schematic perspective view of the container base, partly cut away, with attached sidewall in a folded down position and in a lower position.

FIG. 5 shows a schematic perspective view of the container base 1 with attached sidewall 4 in folded down disposition and in a lower position, with the section plane extending vertically through the nose 6. The U-shaped center part 26 of the guide element 11 bears upon the upper edge 7 of the nose 6. The partition walls 20 project into the incisions 23 of the guide element 11. When folded up, the sidewall 4 swings about the pivot axis A, defined by the hinge bolts 19 and the upper edge 7 of the nose 6 until the locking lugs 30 snap into the depressions 29 on the upper edge 8 of the base frame 2.

Figure 6:
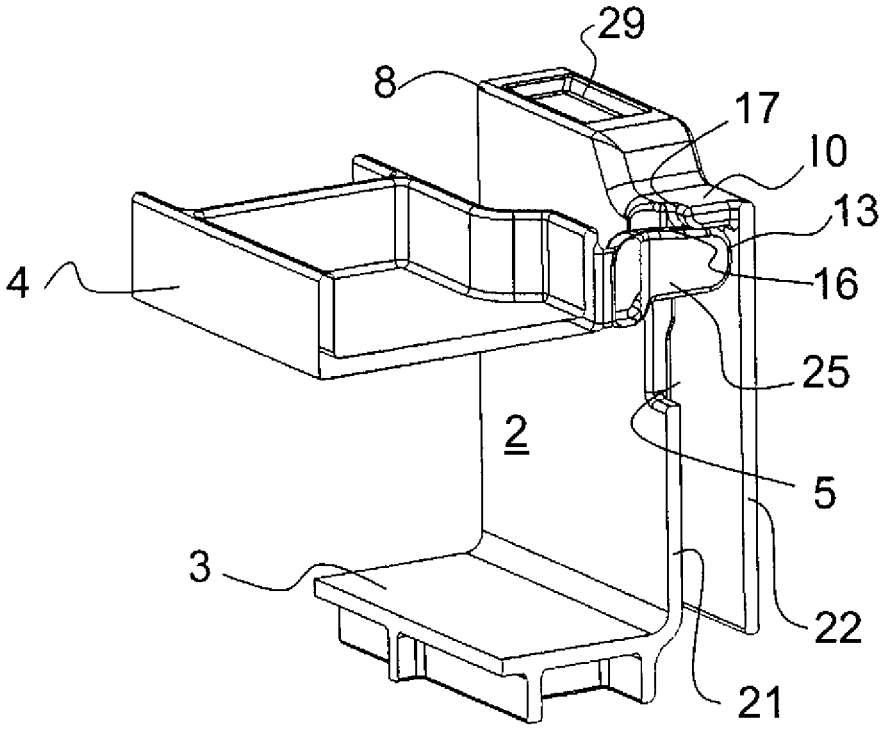
FIG. 6 is a schematic perspective view of the container base with attached sidewall in a folded down position and in an upper position.

FIG. 6 shows a similar schematic perspective view as in FIG. 5, wherein the sidewall 4 is in the upper position. The vertical section plane extends between the hinge arm 25 and the partition wall 20. As can be seen, the backside 16 of the guide element 11 contacts the inner side of the projection 10 and the lower edge 13 bears upon the rear wall 22. When the sidewall 4 is folded up from the front, the edge 17 acts as pivot axis for the sidewall 4 and since the hinge bolts 19 can only be moved vertically as a result of their guidance in the receiving gaps 15, the hinge bolts 19 are pushed down. As the sidewall 4 is provided with at least two guide elements 11, the axis through the hinge bolts 19 shifts in parallel relation to the upper edge 8 of the base frame 2 downwards until the lower edge 13 of the U-shaped center part 26 bears upon the nose 6. When the sidewall 4 assumes an intermediate position between lowermost and uppermost positions, the sidewall 4 is initially pivoted until the backside 16 of the guide element 11 impacts the edge 17. Subsequently, the hinge bolts 19 are again pressed downwards until the lower edge 13 of the U-shaped center part 26 bears upon the nose 6.

The storage and transport container according to the present invention allows a collapsing of the sidewalls and a placement of the sidewalls flatly upon one another. As the sidewalls are folded up, tilting of the sidewalls is prevented by the guide means on the base part and the sidewalls.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A foldable storage and transport container of plastic, comprising:

a container base comprised of a base frame and a base plate;

at least two sidewalls foldable on top of one another, each sidewall having a defined thickness;

at least two hinge connections for articulating each sidewall to the base frame, each said hinge connection comprising a hinge bolt or a hinge pin for pivot engagement in a receiving gap of the base frame, said receiving gap having an elongate opening extending substantially perpendicular to a plane of the base plate to allow the hinge bolt or the hinge pin to move in the receiving gap from a lower end position to an upper end position, said opening having a length sized to at least correspond to the thickness of the sidewall so that the sidewall is liftable in a vertical direction by at least the thickness thereof; and at least two guide elements formed onto the foldable sidewall which are received in corresponding recesses in the base frame, said recesses having each a nose protruding from a bottom of the recess and having an upper edge spaced from an upper edge of the base frame by a distance which corresponds to a length of the guide element from a lower edge of the sidewall such that a lower edge of the guide element bears upon the upper edge of the nose.

2. The container of claim 1, wherein each of the guide elements has a depression for locking engagement by a projection of the base frame in an area of the upper edge of the base frame.

3. The container of claim 2, wherein the hinge bolt or hinge pin is formed at a lower end of the guide element which are received in the receiving gaps of the base frame.

4. The container of claim 3, wherein the guide element has two incisions to divide the guide element in three sections comprised of two outer rail-like hinge arms formed with the hinge bolt or hinge pin, and a center part extending between the hinge arms and having a U-shaped configuration.

5. The container of claim 4, wherein partition walls on opposite sides of the nose are provided in the recesses of the base frame for engagement with the incisions of the guide element.

6. The container of claim 1, wherein the receiving gap for the hinge bolt or hinge pin is formed by inner surfaces of a front and rear walls of the base frame.

* * * * *